US012234631B2

(12) United States Patent
Lin et al.

(10) Patent No.: US 12,234,631 B2
(45) Date of Patent: Feb. 25, 2025

(54) FOAMING SPRAY DEVICE AND TOILET WITH FOAM FOAMING SPRAY DEVICE

(71) Applicant: Komoo Intelligent Technology Co., Ltd., Fujian (CN)

(72) Inventors: Xiaofa Lin, Fujian (CN); Xiaoshan Lin, Fujian (CN); Zuhua Liu, Fujian (CN); Shan Lin, Fujian (CN)

(73) Assignee: Komoo Intelligent Technology Co., Ltd., Fujian (CN)

( * ) Notice: Subject to any disclaimer, the term of this patent is extended or adjusted under 35 U.S.C. 154(b) by 132 days.

(21) Appl. No.: 18/074,123

(22) Filed: Dec. 2, 2022

(65) Prior Publication Data

US 2023/0092995 A1 Mar. 23, 2023

Related U.S. Application Data

(63) Continuation of application No. PCT/CN2020/110384, filed on Aug. 21, 2020.

(30) Foreign Application Priority Data

Jun. 5, 2020 (CN) ..... 202010505650.7
Jun. 30, 2020 (CN) ..... 202010621503.6

(51) Int. Cl.
*E03D 11/11* (2006.01)
*E03D 9/00* (2006.01)

(52) U.S. Cl.
CPC ..... *E03D 9/005* (2013.01); *E03D 11/11* (2013.01)

(58) Field of Classification Search
CPC ..... E03D 9/005; E03D 11/11
USPC ..... 4/223
See application file for complete search history.

(56) References Cited

U.S. PATENT DOCUMENTS 6,042,089 A 3/2000 Klein
2004/0064884 A1* 4/2004 Egeresi ..... E03D 9/005 4/661
2007/0245472 A1* 10/2007 Kao ..... E03D 9/005 4/300

(Continued)

FOREIGN PATENT DOCUMENTS

CN 101228325 A 7/2008
CN 107923168 A 4/2018

(Continued)

OTHER PUBLICATIONS

Corresponding PCT application PCT/CN2020/110384, International Search Report mailed Mar. 3, 2021.

(Continued)

*Primary Examiner* — Huyen D Le
(74) *Attorney, Agent, or Firm* — Cooper Legal Group, LLC

(57) ABSTRACT

The present disclosure discloses a foaming spraying device and a foaming toilet. The foaming spraying device comprises a foaming spraying body. The foaming spraying body comprises a foaming cavity, a suction port, an accelerating hole, and a foam spraying port, each of which is in communication with a foaming cavity. The accelerating hole is configured to enable a foaming solution to be accelerated to enter the foaming cavity of the foaming spraying body, so that the foaming cavity of the foaming spraying body generates negative pressure to suck air through the suction port and the air is mixed with the foaming solution to form foam.

17 Claims, 5 Drawing Sheets

(56) References Cited

U.S. PATENT DOCUMENTS

| | | | | |
|---|---|---|---|---|
| 2009/0126092 | A1* | 5/2009 | Kao | A47K 11/105 4/315 |
| 2018/0291607 | A1 | 10/2018 | Shimasaki et al. | |
| 2022/0341920 | A1* | 10/2022 | Nakashima | G01N 33/52 |

FOREIGN PATENT DOCUMENTS

| | | | |
|---|---|---|---|
| CN | 107923172 | A | 4/2018 |
| CN | 210151855 | U | 3/2020 |
| JP | H08302796 | A | 11/1996 |
| JP | 2008138420 | A | 6/2008 |
| JP | 2008307510 | A | 12/2008 |
| JP | 2017048567 | A | 3/2017 |
| JP | 2017227084 | A | 12/2017 |
| JP | 2023534896 | A | 8/2023 |
| WO | 2007013518 | A1 | 2/2007 |

OTHER PUBLICATIONS

JP Office Action cited in JP Application No. 2022-569490, mailed Apr. 1, 2024, 6 pages.
JP Decision to Grant cited in JP Application No. 2022-569490, mailed Sep. 2, 2024, 5 pages.

* cited by examiner

FOAMING SPRAY DEVICE AND TOILET WITH FOAM FOAMING SPRAY DEVICE

RELATED APPLICATIONS

This application is a continuation of and claims priority to PCT patent application number PCT/CN2020/110384, filed Aug. 21, 2020, which claims priority to Chinese patent application number 202010505650.7, filed on Jun. 5, 2020 and Chinese patent application number 202010621503.6, filed on Jun. 30, 2020. PCT patent application number PCT/CN2020/110384, Chinese patent application number 202010505650.7, and Chinese patent application number 202010621503.6 are incorporated herein by reference.

FIELD OF THE DISCLOSURE

The present disclosure relates to the field of sanitary ware, and in particular to a foaming spraying device and a toilet.

BACKGROUND OF THE DISCLOSURE

At present, an intelligent toilet has many functions such as warm water flushing, warm air drying, seat heating, etc. However, in actual use, a dropping of excrement will splash liquid in the toilet and cause body pollution. At the same time, the excrement will be in a state of natural exposure before being washed away, and the odor is easily emitted and is difficult to remove, which brings inconvenience to people when going to the toilet. Therefore, a foaming toilet appears on the market, and foam generated by a foam generating device covers the toilet bowl, which effectively solves the problem of dirt on the toilet.

At present, a foaming structure on the intelligent toilet on the market is configured to produce foam by mixing foaming agent and water using a foaming stone connected to an air pump, and the foaming structure comprises a water tank, a liquid storage tank, a water pump, a liquid pump, the air pump, etc. The structure is complicated, the volume is large, and the connection structure and the structure that realizes the function of foaming is complicated and inefficient. At the same time, the connection structure and the structure that realizes the function of foaming occupies too much internal space of the intelligent toilet, so that the intelligent toilet with foaming function is large. In addition, in addition to low foaming efficiency and complex structure, the cost is high.

BRIEF SUMMARY OF THE DISCLOSURE

The present disclosure provides a foaming spraying device and a foaming toilet with simple structure and small space occupation to solve the deficiencies in the background.

In order to solve the technical problem, a technical solution of the present disclosure is as follows.

A foaming spraying device comprises a foaming spraying body. The foaming spraying body comprises a foaming cavity, and the foaming spraying body further comprises a suction port, an accelerating hole, and a foam spraying port, each of which is in communication with the foaming cavity. The accelerating hole of the foaming spraying body is configured to enable a foaming solution to be accelerated to enter the foaming cavity of the foaming spraying body, so that the foaming cavity of the foaming spraying body generates negative pressure to suck air through the suction port and the air is mixed with the foaming solution to form foam.

Furthermore, a foaming member is disposed in the foaming cavity of the foaming spraying body such that the foaming solution mixed with the air hits the foaming member to further create foam.

Furthermore, the foaming member comprises a mesh sheet.

Furthermore, the foaming spraying body further comprises a liquid inlet channel upstream of the accelerating hole in a flow direction of the foaming solution. The liquid inlet channel is in communication with the accelerating hole, and a diameter of the accelerating hole is smaller than a diameter of the liquid inlet channel.

Furthermore, the suction port is connected to a foam discharge joint or a foam discharge pipe.

Furthermore, the foaming cavity of the foaming spraying body comprises a blocking wall, which divides the foaming cavity of the foaming spraying body into a first cavity and a second cavity. The blocking wall comprises a through hole enabling communication between the second cavity with the first cavity, and each of the suction port and the accelerating hole is in communication with the first cavity. The foam spraying port is in communication with the second cavity, and the foaming member is located in the second cavity.

Furthermore, a diameter of the through hole is greater than a diameter of the accelerating hole, and the through hole and the accelerating hole are located on a same axis.

Furthermore, the foaming spraying body comprises a self-suction joint, a foaming spraying head, and a foam-guiding spraying head. The foaming spraying head is connected to each of the self-suction joint and the foam-guiding spraying head, and the self-suction joint comprises the first cavity, the suction port, and the accelerating hole. The foaming spraying head comprises the second cavity or cooperates with the foam-guiding spraying head to define the second cavity. The blocking wall is disposed on the foaming spraying head or the self-suction joint, and the foam spraying port is defined on the foaming spraying head.

Furthermore, the foaming spraying body comprises a self-suction joint, a foaming spraying head, and a foam-guiding spraying head, and the foaming spraying head is connected to each of the self-suction joint and the foam-guiding spraying head. The self-suction joint and the foaming spraying head cooperatively define the foaming cavity of the foaming spraying body, or the self-suction joint, the foaming spraying head, and the foam-guiding spraying head cooperatively define the foaming cavity of the foaming spraying body. The self-suction joint comprises the suction port and the accelerating hole, and the foam-guiding spraying head comprises the foam spraying port.

Furthermore, the foaming spraying body comprises a self-suction joint and a foam-guiding spraying head. The self-suction joint is hermetically connected to the foam-guiding spraying head, and the self-suction joint and the foam-guiding spraying head cooperatively define the foaming cavity of the foaming spraying body. The self-suction joint comprises the suction port and the accelerating hole, and the foam-guiding spraying head comprises the foam spraying port.

Furthermore, the self-suction joint is connected to the foaming spraying head in a snap fit manner, and the foaming spraying head is connected to the foam-guiding spraying head in a snap fit manner.

Furthermore, the foam-guiding spraying head comprises a first tube body and a second tube body. The first tube body is horizontally arranged, and the second tube body is obliquely arranged. An upper end of the second tube body is in communication with the first tube body, and a lower end of the second tube body defines the foam spraying port.

Furthermore, the foam-guiding spraying head comprises a mounting seat, and the first tube body is disposed on the mounting seat.

The present disclosure further provides a foaming device comprising a foaming solution supply device. The foaming device further comprises the foaming spraying device, and the foaming solution supply device is configured to supply the foaming solution to the foaming spraying device.

The present disclosure further provides a toilet with the foaming spraying device. The toilet is disposed with the foaming device.

Compared with the existing techniques, the technical solution has the following advantages.

1. Since the foaming spraying body comprises the suction port, the accelerating hole, and the foam spraying port, each of which is in communication with a foaming cavity thereof, the foaming solution is accelerated into the foaming cavity of the foaming spraying body through the accelerating hole, so that the foaming spraying body generates the negative pressure to suck air through the suction port. The air is mixed with the foaming solution to produce foam, so that the present disclosure can achieve foaming without using foaming stones and air pumps. The structure has a simpler structure, smaller size, and is convenient to install, has low cost, and has high foaming efficiency.

2. The arrangement of the foaming member enables the present disclosure to further perform a foaming process, thereby further improving the foaming efficiency and generating a large amount of foam.

3. The foaming member is preferably a mesh sheet, which not only has a simple structure and is convenient to install, but also makes the generated foam more fine and uniform.

4. The self-suction joint further comprises the liquid inlet channel located on the upstream side of the accelerating hole. The liquid inlet channel is in communication with the accelerating hole, which not only makes it easier for the foaming spraying body to be connected to an external foaming solution supply pipe, but also the structure of the accelerating hole can be designed to be more simple, for example, the accelerating hole can be set as a round hole.

5. The suction port is connected to a foam discharge pipe or a foam discharge joint, which can make the foam generated by the residual foaming solution in the foaming spraying device be drained to a suitable position through the foam discharge pipe or the foam discharge joint when in an abnormal situation that the foaming solution is exhausted and the accelerating hole is only supplied with the air. The foam can be avoided to overflowing through the suction port.

6. The arrangement of the blocking wall and the through hole enables the negative pressure generated in the foaming spraying body to circulate in the first cavity of the foaming cavity, thereby increasing a suction force of the external air.

7. The self-suction joint is connected to the foam-guiding spraying head through the foaming spraying head, and the blocking wall is disposed in the foam-guiding spraying head. Therefore, the foaming spraying device of the present disclosure comprises a separable structure achieved by the self-suction joint, the foaming spraying head, and the foam-guiding spraying head. This arrangement enables the structure of the foaming spraying device of the present disclosure easier to manufacture and to be in mass production.

8. The foaming spraying body comprises the self-suction joint, the foaming spraying head, and the foam-guiding spraying head or comprises the self-suction joint and the foam-guiding spraying head, enabling the foaming spraying body easier to manufacture and be in mass production.

9. The foam-guiding spraying head comprises the first tube body and the second tube body, so that the foam-guiding spraying head can be easily adjusted to a proper working state. In particular, the foam-guiding spraying head also comprises a mounting seat. The first tube body is disposed on the mounting seat, so that the installation and positioning of the foam-guiding spraying head can be complete directly by the mounting seat.

DETAILED DESCRIPTION OF THE EMBODIMENTS

Figure 1:
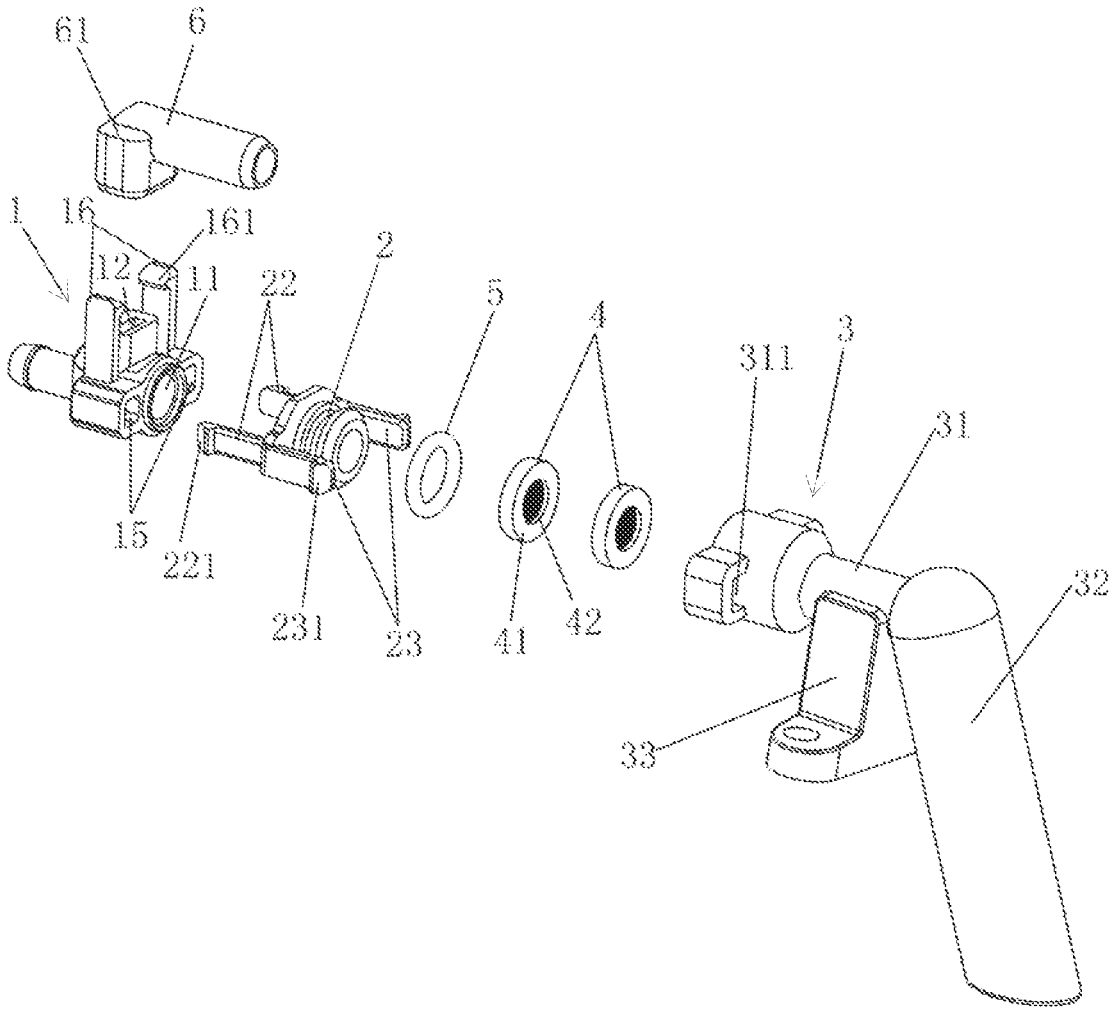
FIG. 1 illustrates an exploded view of a foaming spraying device of Embodiment 1 of the present disclosure.
Figure 2:
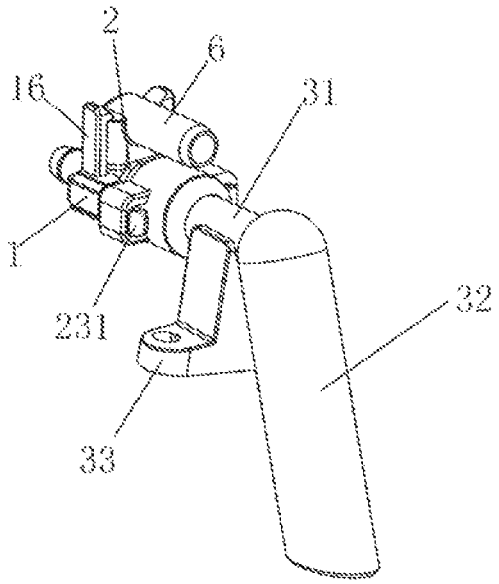
FIG. 2 illustrates a perspective view of the foaming spraying device of Embodiment 1 of the present disclosure.
Figure 3:
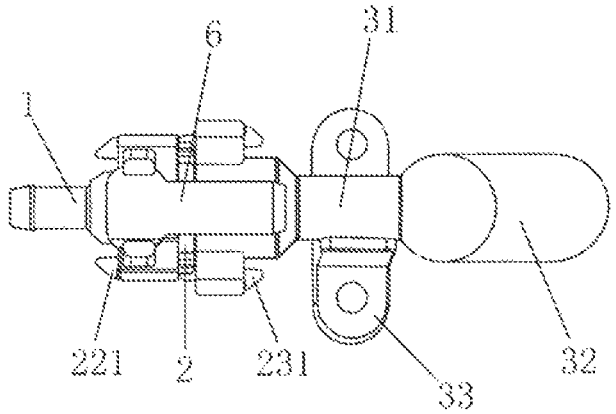
FIG. 3 illustrates a top view of the foaming spraying device of Embodiment 1 of the present disclosure.
Figure 4:
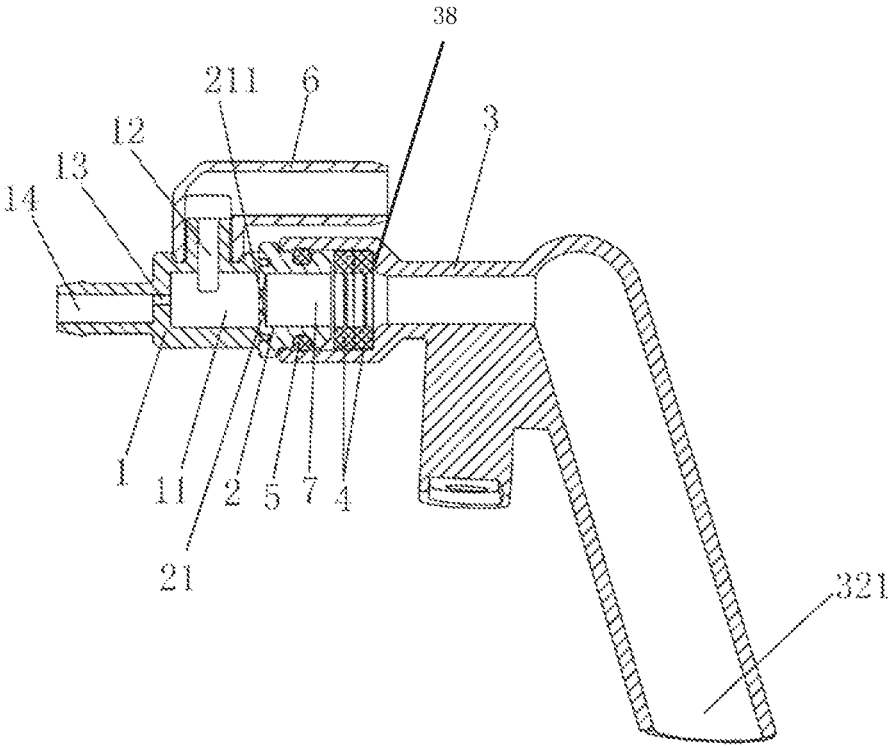
FIG. 4 illustrates a cross-sectional view of the foaming spraying device of Embodiment 1 of the present disclosure.

The present disclosure will be further described below in combination with the accompanying drawings and embodiments.

Embodiment 1

Referring to FIGS. 1 to 5, a foaming spraying device of the present disclosure comprises a foaming spraying body, and the foaming spraying body comprises a suction port 12, an accelerating hole 13, and a foam spraying port 321, each of which is in communication with a foaming cavity thereof. A foaming solution is accelerated by the accelerating hole 13 to enter the foaming cavity of the foaming spraying body, so that the foaming cavity of the foaming spraying body generates negative pressure to suck air through the suction port 12, and the air is mixed with the foaming solution to form foam. The foaming solution is a mixture of water and a foaming agent. The foaming agent is preferably a foaming liquid. The foaming liquid may be a foaming stock solution or a diluted foaming stock solution.

In this embodiment, a foaming member is disposed in the foaming cavity of the foaming spraying body, and the foaming solution mixed with the air hits the foaming member to further create foam.

In this embodiment, the foaming member comprises at least one mesh sheet 4, and in this embodiment, the at least one mesh sheet 4 is at least two mesh sheets 4 spaced apart from each other along a flow direction of the foaming solution. In the illustrate embodiment, the number of mesh sheets 4 is two, but the disclosure is not limited in this regard. In other embodiments, the number of mesh sheets 4 is one, or the number of mesh sheets 4 is more than two. The at least one mesh sheet 4 has a circular structure and comprises a fixed ring 41 and a mesh sheet 42 enclosed by the fixed ring 41. The at least one mesh sheet 42 comprises a plurality of mesh holes evenly arranged thereon. In other embodiments, the foaming member comprises a plurality of barrier strips spaced apart from one another.

In this embodiment, the foaming cavity of the foaming spraying body comprises a blocking wall 21, which divides the foaming cavity of the foaming spraying body into a first cavity 11 and a second cavity 7. The blocking wall 21 comprises a through hole 211 enabling communication between the second cavity 7 and the first cavity 11. Each of the suction port 12 and the accelerating hole 13 is in communication with the first cavity 11, and the foam spraying port 321 is in communication with the second cavity 7. The foaming member (i.e., the at least two mesh sheets 4) is located in the second cavity 7. A diameter of the through hole 211 is greater than a diameter of the accelerating hole 13, and the through hole 211 and the accelerating hole 13 are located on a same axis (i.e., the through hole 211 and the accelerating hole 13 are co-axial), but the disclosure is not limited in this regard. An arrangement of the blocking wall 21 and the through hole 211 enables the negative pressure generated in the foaming spraying body to circulate in the first cavity 11 of the foaming cavity, thereby increasing a suction force to external air.

In this embodiment, the foaming spraying body further comprises a liquid inlet channel 14 located upstream of the accelerating hole 13 in a flow direction of the foaming solution, and the liquid inlet channel 14 is in communication with the accelerating hole 13. Each of the diameter of the accelerating hole 13 and the diameter of the through hole 211 is smaller than a diameter of the liquid inlet channel 14. In other embodiments, the accelerating hole 13 is a diameter-variable hole, such as a tapered hole.

In this embodiment, the suction port 12 is connected to a foam discharge joint 6, and the foam discharge joint 6 is configured to be connected to a foam discharge pipe. In other embodiments, the suction port 12 is directly connected to the foam discharge pipe. The foam discharge joint 6 is substantially L-shaped, and a vertical part thereof faces downward to be connected to the suction port 12. An arrangement of the foam discharge joint 6 or the foam discharge pipe can make the foam generated by the foaming solution that remains in the foaming spraying device be guided to a proper position through the foam discharge pipe or the foam discharge joint 6 when the foaming solution is exhausted. The accelerating hole 13 only pushes the air into the first cavity 11, so as to prevent the foam from overflowing around through the suction port 12.

In this embodiment, the foaming spraying body comprises a self-suction joint 1, a foaming spraying head 2, and a foam-guiding spraying head 3, and the foaming spraying head 2 is connected to each of the self-suction joint 1 and the foam-guiding spraying head 3. The self-suction joint 1 comprises the first cavity 11, the suction port 12, the accelerating hole 13, and the liquid inlet channel 14. The foaming spraying head 2 and the foam-guiding spraying head 3 cooperatively define the second cavity 7, but the disclosure is not limited in this regard. In other embodiments, the foaming spraying head 2 comprises the second cavity. The blocking wall 21 is disposed at a first end of the foaming spraying head 2, and a second end of the foaming spraying head 2 is open. The foam spraying port 321 is disposed on the foam-guiding spraying head 3. In other embodiments, the blocking wall 21 is disposed on the self-suction joint 1. Therefore, the foaming spraying body of the present disclosure comprises the self-suction joint 1, the foaming spraying head 2, and the foam-guiding spraying head 3, which are assembled together. This arrangement makes a structure of the foaming spraying device of the present disclosure easier to manufacture and be in mass production. In other embodiments, the foaming spraying body is integrally formed and can be manufactured by three-dimensional (3D) printing.

In this embodiment, the self-suction joint 1 is connected to the foaming spraying head 2 in a snap fit manner, and the foaming spraying head 2 is connected to the foam-guiding spraying head 3 in a snap fit manner. The foaming spraying head 2 is partially inserted into the foam-guiding spraying head 3 (e.g., the foaming spraying head 2 is sleeved with a sealing ring 5 to facilitate sealing a gap between the foam-guiding spraying head 3 and the foaming spraying head 2). A part of the second cavity 7 is located in the foaming spraying head 2, and the rest of the second cavity 7 is located in the foam-guiding spraying head 3 and is disposed with the foaming member (i.e., the at least two mesh sheets 4). The at least two mesh sheets 4 are clamped between the foaming spraying head 2 and a position-limiting step 38 inside the foam-guiding spraying head 3.

In this embodiment, the foam-guiding spraying head 3 specifically comprises a first tube body 31 and a second tube body 32. The first tube body 31 is horizontally arranged, the second tube body 32 is obliquely arranged, and a first end of the first tube body 31 is connected to the foaming spraying head 2 to cooperatively define the second cavity 7. Specifically, the foaming spraying head 2 is sleeved and matched with the first tube body 31. When installing, the at least two mesh sheets 4 are first disposed in the first tube body 31, and then the foaming spraying head 2 is partially sleeved into the first tube body 31 to enable the at least two mesh sheets 4 to be position-limited by an annular limiting step inside the foaming spraying head 2. A second end of the first tube body 31 is connected to an upper end of the second tube body 32, and an included angle between the first tube body 31 and the second tube body 32 is greater than 90 degrees. A lower end of the second tube body 32 defines the foam spraying port 321. The foam-guiding spraying head 3 further comprises a mounting seat 33 comprising a mounting hole, and the first tube body 31 is disposed on the mounting seat 33.

In this embodiment, a snap connection between the self-suction joint 1 and the foaming spraying head 2 is as follows. The self-suction joint 1 comprises two first locking grooves 15, and the foaming spraying head 2 comprises two first elastic locking claws 22 facing the self-suction joint 1. Opposite outer sides of tail ends of the two first elastic locking claws 22 respectively comprise two first reverse hooks 221. When connecting, the two first elastic locking claws 22 pass through the two first locking grooves 15 one by one, and the two first reverse hooks 221 of the two first elastic locking claws 22 are respectively locked to an edge of an end of the two first locking grooves 15 away from the foaming spraying head 2. A snap connection between the foaming spraying head 2 and the foam-guiding spraying head 3 is as follows. The first tube body 31 of the foam-guiding spraying head 3 comprises two second locking grooves 311, and the foaming spraying head 2 comprises two second elastic locking claws 23 facing the foam-guiding spraying head 3. Opposite outer sides of tail ends of the two second elastic locking claws 23 respectively comprise two second reverse hooks 231. When connecting, the two second elastic locking claws 23 pass through the two second locking grooves 311 one by one, and the second reverse hooks 231 of the two second elastic locking claws 23 are respectively locked to an edge of an end of the second locking grooves 311 away from the foaming spraying head 2.

In this embodiment, the foam discharge joint 6 and the self-suction joint 1 are also connected together by a snap connection. Specifically, the foam discharge joint 6 is substantially L-shaped, and the vertical part of the foam discharge joint 6 faces downward and is connected to a part at which the suction port 12 of the self-suction joint 1 is located. The vertical part of the foam discharge joint 6 comprises two buckle blocks 61, and the self-suction joint 1 comprises two third elastic locking claws 16 facing upward. Two tail ends of the third elastic locking claws 16 respectively comprise two third reverse hooks 161, and the two third reverse hooks 161 face each other. When connecting, the two third elastic locking claws 16 are located at opposite outer sides of the two buckle blocks 61, and the two third reverse hooks 161 of the two third elastic locking claws 16 are respectively locked to top ends of the two buckle blocks 61.

The foaming spraying device of the present disclosure is used in conjunction with a foaming solution supply device when applied, and the foaming spraying device is applied to a smart toilet. The foaming principle is as follows.

Figure 5:
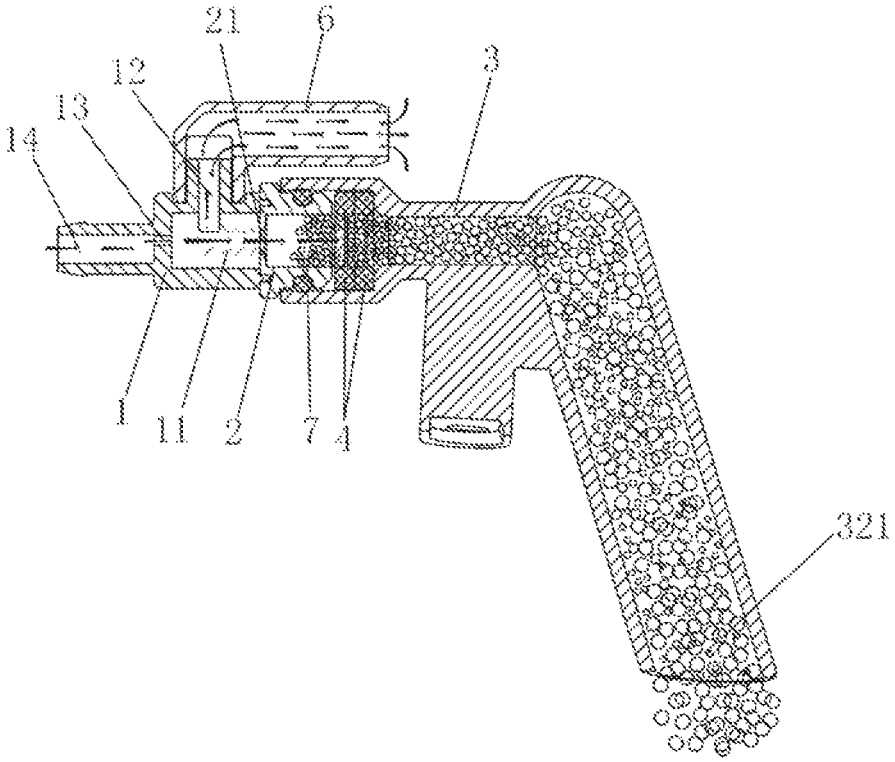
FIG. 5 illustrates a cross-sectional view of the foaming spraying device of Embodiment 1 of the present disclosure during a foaming process.

The foaming solution enters the first cavity 11 from the liquid inlet channel 14 of the self-suction joint 1 in the form of a water column after being accelerated and pressurized by the accelerating hole 13 to form a Venturi effect so as to form the negative pressure in the first cavity 11. The external air is sucked into the first cavity 11 from the suction port 12, and the air and the foaming solution are mixed in the first cavity 11 to undergo a first foaming process. The foaming solution enters the second cavity 7 while continuing to be pushed forward, and the foaming solution hits the at least two mesh sheets 4 successively, thereby undergoing a second foaming process and a third foaming process. After the foaming is complete, the foam is propelled by the foaming solution at a rear end of the foaming and spraying device, and the foam is finally discharged through the foam spraying port 321 of the foam-guiding spraying head 3, as shown in FIG. 5.

The foaming spraying device of the present disclosure sucks the air in through a self-suction method, and the second foaming process and the third foaming process are performed by hitting the foaming member to generate a large amount of foam. The whole foaming process does not need to use a foam stone and an air pump. The structure is very simple, the size of the foaming spraying device is small, the installation is convenient, the cost is low, and the foaming efficiency is high.

Figure 6:
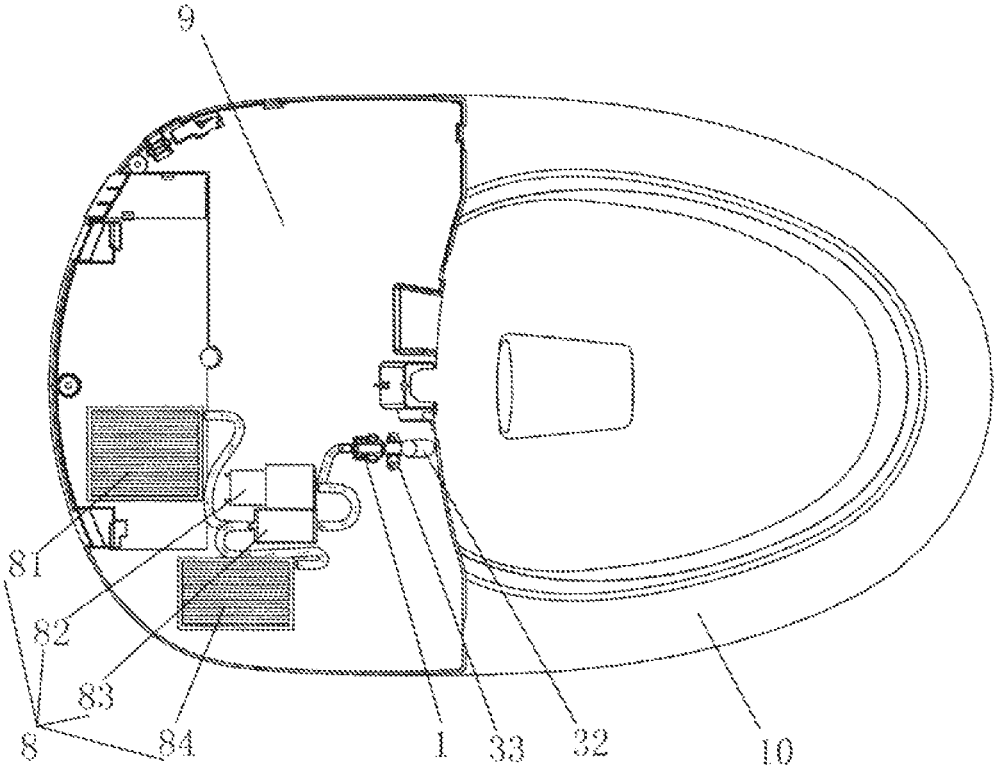
FIG. 6 illustrates a perspective view of the foaming device/foaming toilet of Embodiment 1 of the present disclosure.
Figure 7:
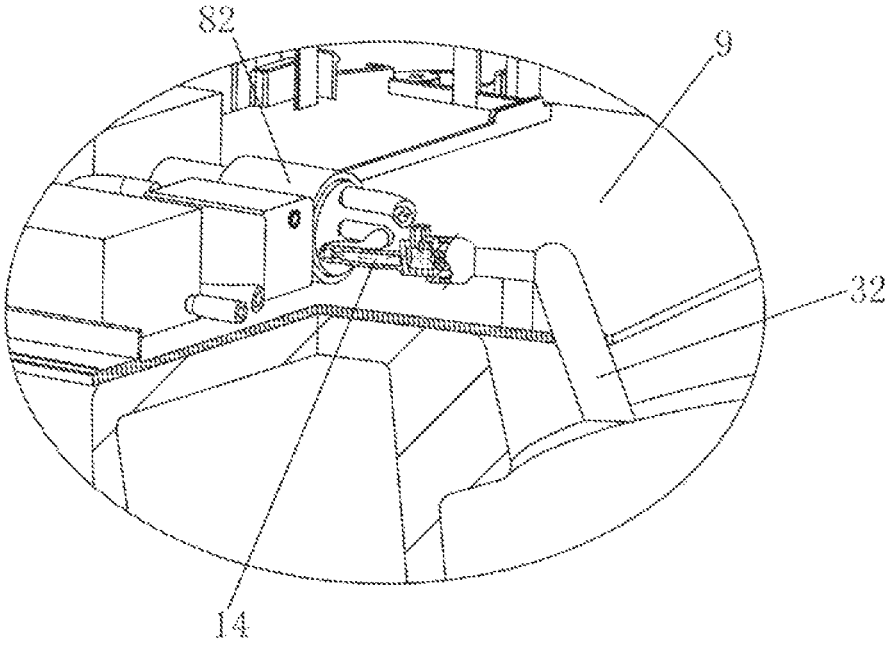
FIG. 7 illustrates a partial cross-sectional view of the foaming device/foaming toilet of Embodiment 1 of the present disclosure.

Referring to FIGS. 6 and 7, a foaming device of the present disclosure comprises the foaming solution supply device 8 and the foaming spraying device of the present disclosure. The foaming spraying device is supplied with the foaming solution provided by the foaming solution supply device 8. The foaming solution supply device 8 specifically comprises a water tank 81, a liquid storage box 84, a mixing valve 83, and a pump body 82. A water inlet of the mixing valve 83 is in communication with the water tank 81, and a liquid inlet pipeline of the mixing valve 83 is in communication with the liquid storage box 84. A mixed liquid outlet of the mixing valve 83 is in communication with an input end of the pump body 82, and an output end of the pump body 82 is in communication with the liquid inlet channel 14 of the foaming spraying device. When in a working process, the pump body 82 is started, air in the mixing valve 83 is pumped out to generate negative pressure, and the water and the foaming agent are sucked in through the water inlet and liquid inlet pipeline respectively (the foaming agent is the foaming stock solution or the diluted foaming stock solution). The water and the foaming agent are fully mixed in the mixing valve 83 to form the foaming solution. The foaming solution enters the pump body 82 from the mixed liquid outlet of the mixing valve 83 and is output to the liquid inlet channel 14 of the foaming spraying device through a pipeline. The foaming solution enters the first cavity 11 after being accelerated and pressurized through the accelerating hole 13 to form the Venturi effect, so that the first cavity 11 forms the negative pressure and sucks the external air from the suction port 12. The foaming solution and the external air are mixed in the first cavity 11 to undergo the first foaming process. As the foaming solution continues to be pushed forward, the foaming solution hits the at least two mesh sheets 4 one after another, resulting in the second foaming process and the third foaming process. After the foaming is complete, the foam is propelled by the foaming solution at the rear end of the foaming and spraying device and the foam is finally discharged through the foam spraying port 321 of the foam-guiding spraying head 3.

The foaming solution supply device 8 may also adopt the following structure. The foaming solution supply device 8 comprises the liquid storage box 84, the water tank 81, the mixing valve 83, and two of the pump bodies 82. An input end of a first one of the two pump bodies 82 is in communication with the water tank 81, and an output of the first one of the two pump bodies 82 is in communication with a water inlet of the mixing valve 83. An input end of a second one of the two pump bodies 82 is in communication with the liquid storage box 84, and an output end of the second one of the two pump bodies 82 is in communication with a liquid inlet passage of the mixing valve 83. A mixed liquid outlet of the mixing valve 83 is in communication with the liquid inlet channel of the foaming spraying device. When working, the foaming agent in the liquid storage box 84 is output to the mixing valve 83 by controlling the second one of the two pump bodies 82 to work firstly, and then the first one of the two pump bodies 82 is started to input the water into the mixing valve 83 to be mixed with the foaming agent to form the foaming solution. The first one of two pump bodies 82 pumps the water into the mixing valve 83, and the following two actions can be performed: a) the action of pumping water can be stopped after quantitative or timing input, and b) continuing to pump water into the mixing valve 83, so that the water can provide a push to the foaming solution in the mixing valve 83 to enable the foaming solution to be pushed to the foaming spraying device.

The foaming device of the present disclosure can be applied to a smart toilet. When installing, the foaming device is installed on a supporting body disposed at a top end of a back of a toilet seat 10 (e.g., the supporting body is specifically a supporting plate 9, but the disclosure is not limited to this). The second tube body 32 of the foam-guiding spraying head 3 of the foaming spraying device is set to pass through the supporting body and extend into a toilet bowl of the toilet seat 10, so as to spray the foam onto a water cover of the toilet bowl.

Referring to FIGS. 6 and 7, a foaming toilet of the present disclosure, which is the smart toilet, comprises the toilet seat 10 and the foaming device of the present disclosure. Specifically, the foaming spraying device is installed on the supporting body disposed at the top end of the back of the toilet seat 10 by the mounting seat 33 (e.g., the supporting body is specifically the supporting plate 9, but the disclosure is not limited to this), and the second tube body 32 of the foam-guiding spraying head 3 of the foaming spraying device passes through the supporting body into the toilet bowl of the toilet seat 10, so as to spray the foam onto the water cover of the toilet bowl. The foaming solution supply device 8 is also disposed on the supporting body.

In the foaming toilet of the present disclosure, the foaming principle of the foaming spraying device is as described above and will not be repeated here.

Embodiment 2

Figure 8:
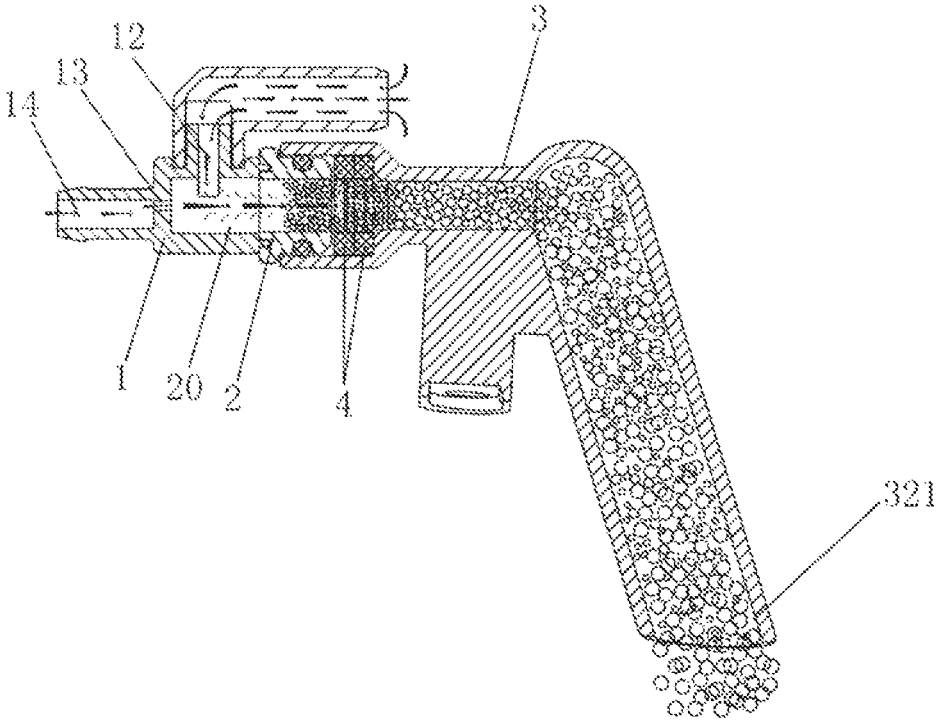
FIG. 8 illustrates a cross-sectional view of the foaming spraying device of Embodiment 2 of the present disclosure during a foaming process.

Referring to FIG. 8, the difference between the foaming spraying device of the present disclosure in this Embodiment and Embodiment 1 is that there is not blocking wall 21 in the foaming cavity 20 of the foaming spraying body.

In this embodiment, the foaming spraying body also comprises a self-suction joint 1, a foaming spraying head 2, and a foam-guiding spraying head 3, and the foaming spraying head 2 is connected to each of the self-suction joint 1 and the foam-guiding spraying head 3. The self-suction joint 1, the foaming spraying head 2, and the foam-guiding spraying head 3 cooperatively define the foaming cavity 20 of the foaming spraying body, but the disclosure is not limited to this. In other embodiments, the self-suction joint 1 and the foaming spraying head 2 cooperatively define the foaming cavity 20 of the foaming spraying body. Opposite ends of the foaming spraying head 2 respectively is open, an end of the self-suction joint 1 opposite to the accelerating hole 13 is also open, and the foam spraying port 321 is defined on the foam-guiding spraying head 3. The connection of the self-suction joint 1, the foaming spraying head 2, and the foam-guiding spraying head 3 is as described above, and will not be repeated here. In other embodiments, the foaming spraying body is integrally formed.

In the foaming spraying device of the present disclosure, when working, the foaming solution enters the liquid inlet channel 14 of the self-suction joint 1 in a form of a water column, and the foaming solution is accelerated and pressurized by the accelerating hole 13 to enter the foaming cavity 20 so as to form a Venturi effect. As a result, negative pressure is formed in the foaming cavity 20 and the external air is sucked in from the suction port 12, and the external air is mixed with the foaming solution to undergo a first foaming process. While the foaming solution continues to be pushed forward, the foaming solution hits the at least two mesh sheets 4 successively, thereby undergoing a second foaming process and a third foaming process. After the foaming is completed, the foam is propelled by the foaming solution at the rear end of the foaming and spraying device, and the foam is finally discharged through the foam spraying port 321 of the foam-guiding spraying head 3, as shown in FIG. 8.

Embodiment 3

Figure 9:
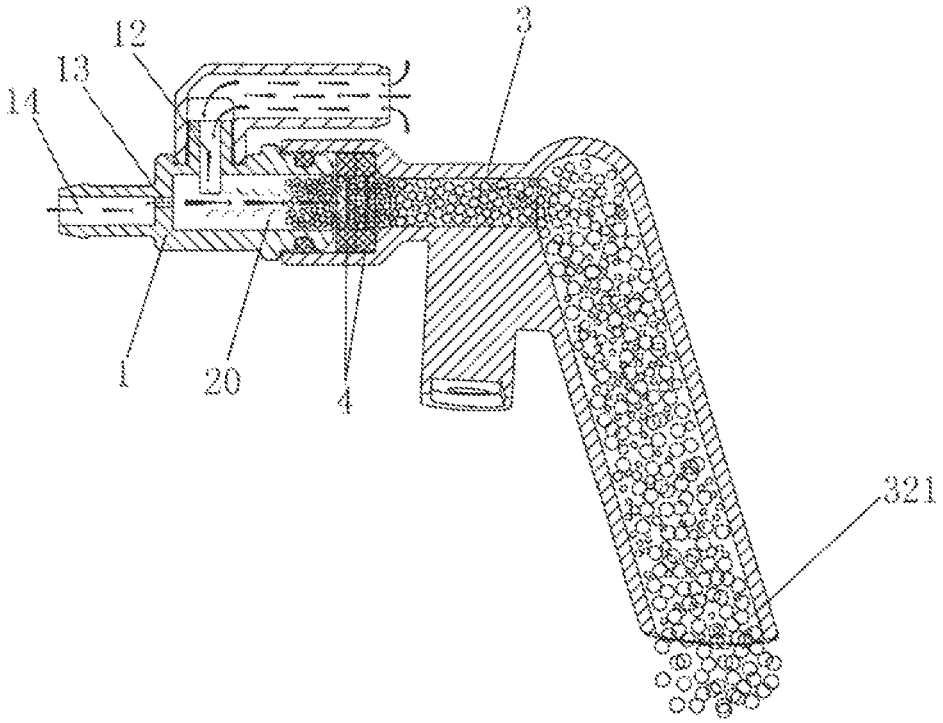
FIG. 9 illustrates a cross-sectional view of the foaming spraying device of Embodiment 3 of the present disclosure during a foaming process.

Referring to FIG. 9, a foaming spraying device of the present disclosure is provided, which differs from Embodiment 2 in that the foaming spraying body comprises a self-suction joint 1 and a foam-guiding spraying head 3. The self-suction joint 1 is hermetically connected to the foam-guiding spraying head 3. The self-suction joint 1 and the foam-guiding spraying head 3 cooperatively define the foaming cavity 20 of the foaming spraying body. The foaming cavity 20 is also not disposed with the blocking wall 21, but the disclosure is not limited to this. In other embodiments, the foaming cavity is disposed with the blocking wall 21 as described in Embodiment 1. Specifically, an end of the self-suction joint 1 opposite to the liquid inlet channel 14 is sleeved and matched with the foam-guiding spraying head 3, and the self-suction joint 1 and the foam-guiding spraying head 3 can be further fixedly connected together by a snap connection. A structure of the foam-guiding spraying head 3 is the same as that of the foam-guiding spraying head 3 described in Embodiment 1 or Embodiment 2.

In the foaming spraying device of the present disclosure, when working, the foaming solution enters the liquid inlet channel 14 of the self-suction joint 1 in a form of a water column, and the foaming solution is accelerated and pressurized by the accelerating hole 13 to enter the foaming cavity 20 so as to form a Venturi effect. As a result, the negative pressure is formed in the foaming cavity 20 and the external air is sucked in from the suction port 12, and the external air is mixed with the foaming solution to undergo a first foaming process. While the foaming solution continues to be pushed forward, the foaming solution hits the at least two mesh sheets 4 successively, thereby undergoing a second foaming process and a third foaming process. After the foaming is complete, the foam is propelled by the foaming solution at the rear end of the foaming and spraying device, and the foam is finally discharged through the foam spraying port 321 of the foam-guiding spraying head 3, as shown in FIG. 9.

The aforementioned embodiments are merely some embodiments of the present disclosure, and the scope of the disclosure is not limited thereto. Thus, it is intended that the present disclosure cover any modifications and variations of the presently presented embodiments provided they are made without departing from the appended claims and the specification of the present disclosure.

What is claimed is:

1. A foaming spraying device, comprising:

a foaming spraying body, wherein:

the foaming spraying body comprises a foaming cavity, the foaming spraying body further comprises a suction port, an accelerating hole and a foam spraying port, each of which is in communication with the foaming cavity, the accelerating hole of the foaming spraying body is configured to enable a foaming solution to be accelerated to enter the foaming cavity of the foaming spraying body, so that the foaming cavity of the foaming spraying body generates negative pressure to suck air through the suction port and the air is mixed with the foaming solution to form foam, the foaming spraying body comprises a self-suction joint, a foaming spraying head, and a foam-guiding spraying head, the foaming spraying head is connected to each of the self-suction joint and the foam-guiding spraying head, the self-suction joint and the foaming spraying head cooperatively define the foaming cavity of the foaming spraying body, or the self-suction joint, the foaming spraying head, and the foam-guiding spraying head cooperatively define the foaming cavity of the foaming spraying body, the self-suction joint comprises the suction port and the accelerating hole, and the foam-guiding spraying head comprises the foam spraying port.

2. The foaming spraying device according to claim 1, wherein:

a foaming member is disposed in the foaming cavity of the foaming spraying body such that the foaming solution mixed with the air hits the foaming member to further create the foam.

3. The foaming spraying device according to claim 2, wherein:

the foaming member comprises a mesh sheet.

4. The foaming spraying device according to claim 3, wherein:

the foaming cavity of the foaming spraying body comprises a blocking wall, which divides the foaming cavity of the foaming spraying body into a first cavity and a second cavity, the blocking wall comprises a through hole enabling communication between the second cavity and the first cavity, each of the suction port and the accelerating hole is in communication with the first cavity, the foam spraying port is in communication with the second cavity, and the foaming member is located in the second cavity.

5. The foaming spraying device according to claim 2, wherein:

the foaming cavity of the foaming spraying body comprises a blocking wall, which divides the foaming cavity of the foaming spraying body into a first cavity and a second cavity, the blocking wall comprises a through hole enabling communication between the second cavity and the first cavity, each of the suction port and the accelerating hole is in communication with the first cavity, the foam spraying port is in communication with the second cavity, and the foaming member is located in the second cavity.

6. The foaming spraying device according to claim 5, wherein:

a diameter of the through hole is greater than a diameter of the accelerating hole, and the through hole and the accelerating hole are located on a same axis.

7. The foaming spraying device according to claim 5, wherein:

the self-suction joint further comprises the first cavity, the foaming spraying head comprises the second cavity or cooperates with the foam-guiding spraying head to define the second cavity, the blocking wall is disposed on the foaming spraying head or the self-suction joint, and the foam spraying port is defined on the foam-guiding spraying head.

8. The foaming spraying device according to claim 7, wherein:

the self-suction joint is connected to the foaming spraying head in a snap fit manner, and the foaming spraying head is connected to the foam-guiding spraying head in a snap fit manner.

9. The foaming spraying device according to claim 7, wherein:

the foam-guiding spraying head comprises a first tube body and a second tube body, the first tube body is horizontally arranged, the second tube body is obliquely arranged, an upper end of the second tube body is in communication with the first tube body, and a lower end of the second tube body defines the foam spraying port.

10. The foaming spraying device according to claim 9, wherein:

the foam-guiding spraying head comprises a mounting seat, and the first tube body is disposed on the mounting seat.

11. The foaming spraying device according to claim 1, wherein:

the foaming spraying body further comprises a liquid inlet channel located upstream of the accelerating hole in a flow direction of the foaming solution, the liquid inlet channel is in communication with the accelerating hole, and a diameter of the accelerating hole is smaller than a diameter of the liquid inlet channel.

12. The foaming spraying device according to claim 1, wherein:

the suction port is connected to a foam discharge joint or a foam discharge pipe.

13. A foaming device, comprising a foaming solution supply device, wherein:

the foaming device further comprises the foaming spraying device according to claim 1, and the foaming solution supply device is configured to supply the foaming solution to the foaming spraying device.

14. A toilet with the foaming spraying device, wherein:

the toilet is disposed with the foaming device according to claim 13.

15. A foaming spraying device, comprising:

a foaming spraying body, wherein:

the foaming spraying body comprises a foaming cavity, the foaming spraying body further comprises a suction port, an accelerating hole and a foam spraying port, each of which is in communication with the foaming cavity, the accelerating hole of the foaming spraying body is configured to enable a foaming solution to be accelerated to enter the foaming cavity of the foaming spraying body, so that the foaming cavity of the foaming spraying body generates negative pressure to suck air through the suction port and the air is mixed with the foaming solution to form foam, the foaming spraying body comprises a self-suction joint and a foam-guiding spraying head, the self-suction joint is hermetically connected to the foam-guiding spraying head, the self-suction joint and the foam-guiding spraying head cooperatively define the foaming cavity of the foaming spraying body, the self-suction joint comprises the suction port and the accelerating hole, and the foam-guiding spraying head comprises the foam spraying port.

16. The foaming spraying device according to claim 15, wherein:

the foam-guiding spraying head comprises a first tube body and a second tube body, the first tube body is horizontally arranged, the second tube body is obliquely arranged, an upper end of the second tube body is in communication with the first tube body, and a lower end of the second tube body defines the foam spraying port.

17. A foaming spraying device, comprising:

a foaming spraying body, wherein:

the foaming spraying body comprises a foaming cavity, the foaming spraying body further comprises a suction port, an accelerating hole and a foam spraying port, each of which is in communication with the foaming cavity, the accelerating hole of the foaming spraying body is configured to enable a foaming solution to be accelerated to enter the foaming cavity of the foaming spraying body, so that the foaming cavity of the foaming spraying body generates negative pressure to suck air through the suction port and the air is mixed with the foaming solution to form foam, a foaming member is disposed in the foaming cavity of the foaming spraying body such that the foaming solution mixed with the air hits the foaming member to further create the foam, the foaming cavity of the foaming spraying body comprises a blocking wall, which divides the foaming cavity of the foaming spraying body into a first cavity and a second cavity, the blocking wall comprises a through hole enabling communication between the second cavity and the first cavity, each of the suction port and the accelerating hole is in communication with the first cavity, the foam spraying port is in communication with the second cavity, the foaming member is located in the second cavity, the foaming spraying body comprises a self-suction joint, a foaming spraying head, and a foam-guiding spraying head, the foaming spraying head is connected to each of the self-suction joint and the foam-guiding spraying head, the self-suction joint comprises the first cavity, the suction port, and the accelerating hole, the foaming spraying head comprises the second cavity or cooperates with the foam-guiding spraying head to define the second cavity, the blocking wall is disposed on the foaming spraying head or the self-suction joint, and the foam spraying port is defined on the foaming spraying head.

* * * * *